US006158250A

United States Patent [19]

Tibbals, Jr. et al.

[11] Patent Number: 6,158,250

[45] Date of Patent: Dec. 12, 2000

[54] FLAT-BED KNITTING MACHINE AND METHOD OF KNITTING

[75] Inventors: Edward Camp Tibbals, Jr., Thomasville; Karl Robert Leinsing, Raleigh; Paul Brad DeMarco, Charlotte, all of N.C.

[73] Assignee: Novacept, Palo Alto, Calif.

[21] Appl. No.: 09/503,317

[22] Filed: Feb. 14, 2000

[51] Int. Cl.[7] ..... D04B 7/00

[52] U.S. Cl. ..... 66/62; 66/64

[58] Field of Search ..... 66/13, 216, 218, 66/62, 64, 147, 149 R, 152, 146, 1 R

[56] References Cited

U.S. PATENT DOCUMENTS

| | | |
|---|---|---|
| 3,307,376 | 3/1967 | Seiler . |
| 3,608,335 | 9/1971 | Ercole et al. . |
| 3,668,895 | 6/1972 | Bruelemans . |
| 3,668,896 | 6/1972 | Betts et al. . |
| 4,192,157 | 3/1980 | Hida et al. . |
| 4,539,826 | 9/1985 | Leins et al. . |

FOREIGN PATENT DOCUMENTS

| | | | |
|---|---|---|---|
| 235987 | 9/1987 | European Pat. Off. | 66/216 |
| 717136 | 6/1996 | European Pat. Off. | 66/216 |

*Primary Examiner*—Danny Worrell
*Attorney, Agent, or Firm*—Alston & Bird LLP

[57] ABSTRACT

A flat bed knitting apparatus and method of knitting are provided in which needles movably carried in opposing needle beds are selected and actuated for movement between various positions required for stitch formation independently of any other needles while completing the formation of a stitch on each selected needle prior to the actuation of the next needle in sequence and while varying the length of needle movement to its stitch forming position as required for uniform stitches throughout the fabric and in which a covered spandex yarn is fed to the needles while varying the tension thereof for uniform stitch formation. The needle selection and actuation further includes tapering the knit fabric by transferring stitches from selected needles in one needle bed onto adjacent needles in the other needle bed so that the knit fabric formed is a tapered, tubular knit product.

32 Claims, 8 Drawing Sheets

FLAT-BED KNITTING MACHINE AND METHOD OF KNITTING

FIELD OF THE INVENTION

The present invention relates to knitting machines and more particularly to a flat-bed knitting machine and method of knitting seamless tapered products.

BACKGROUND OF THE INVENTION

In all knitting machines, there are certain common requirements which are essential to produce acceptable quality knit fabric. Several of these requirements may, at first glance, appear trivial, but in the context of differing yarn properties and the non-isotropic nature of composite yarns, are particularly difficult, if not impossible, to achieve with knitting machines heretofore available.

In order for the fabric to be smooth and free from lumps, defects and unwanted variations, the knitting instrumentalities must be able to form stitches sequentially which are the same size or which vary in some predictable manner. Since producing knit fabric still remains an open loop process, prior knitting machines move each needle through a fixed predetermined path of travel while it is assumed that the stitches formed thereby will be of the proper, uniform size and shape. However, since the stitches are sequentially formed, one after another, from the same yarn, there is simply no way to alter the size of any stitch after the next stitch is formed.

In conventional knitting machines, the needles are moved longitudinally by butt engaging cams through the aforementioned predetermined path of travel. In some knitting machines, such as circular knitting machines, the needles are moved past stationary butt-engaging cams, while in other knitting machines, such as flat-bed knitting machines, the cams are moved relative to the needles. The speed and nature of such relative movement of the butt-engaging cams and the needles to effect stitch formation is severely restricted by frictional problems attendant to pushing perpendicular to the desired direction of travel and the limitations of cam design.

In this regard, the slopes of the cams must be less than 52° and therefore, several needles must be moved simultaneously in order to obtain the necessary travel distances. Therefore, the yarn is fed to and captured by a succeeding needle before preceding needles have completed the stitch formation process. The capstan effect frictional problems between the yam and the knitting instrumentalities accentuate even minor variations in the yarn properties and knitting instrumentalities movements, resulting in uneven stitches and a fabric with lumps, defects and unwanted variations.

When knitting common jersey fabric, all of the stitches are the same and therefore, all of the needles are moved the same way all of the time. However, in knitting contoured knit products, the needles must be moved in different patterns from time to time. With cam systems heretofore employed, it was necessary to shunt the butts of the needles from one cam track to another by elaborate mechanical or electromechanical devices. Even with the most elaborate cam actuation system, such shunting movement is limited and the different motions that could be imparted to any given needle are severely restricted.

In designing such prior cam systems, it was assumed that the yarns to be knitted were inelastic and had a stiffness of zero. It was also assumed that these yarns were supplied from a source under uniform or constant tension. However, when the fabric is knit from covered spandex yarns, such linear assumptions yield a design that is incapable of producing uniform stitch size and a flat, smooth fabric.

SUMMARY OF THE INVENTION

With the foregoing in mind, it is an object of the present invention to provide an apparatus and method of knitting a flat, smooth fabric from yarns, including covered spandex yarns, which overcome the deficiencies and disadvantages of the aforementioned prior apparatus and methods.

It is another object of the present invention to provide a flat bed knitting machine and method in which each stitch can be completely formed prior to commencing the formation of the next stitch and in which subsequent stitches are formed from a length of yarn corresponding to the length of the yarn used to form the preceding stitch.

It is a further object of the present invention to provide a flat bed knitting machine and method in which each needle is moved between its various operative positions independently of any other needles and wherein the exact position of the needle being moved is monitored and varied as required to produce a tapered fabric that is seamless, smooth and devoid of lumps, defects and unwanted variations.

The foregoing objects of the present invention are accomplished by a flat bed knitting machine having two banks of needles, preferably substantially at 90° to each other, with one bank being movable laterally by one needle pitch relative to the other bank of needles. Each bank of needles is provided with a computer controlled needle selection and actuating mechanism which selects an individual needle to be moved in accordance with a predetermined pattern stored in the memory of the computer and moves that needle sequentially among any of thousands of various operative positions to receive a yarn from a yarn feeding device and to form a stitch from a predetermined length of the yam. While that needle is being moved to form the stitch, the remaining needles preferably remain stationary and another needle is not selected and moved until the preceding stitch is fully formed or completed.

The needle selection and actuating mechanism is servo driven and therefore, can very accurately position each needle at an almost infinite number of positions to ensure a very high degree of uniformity of stitch structure and operability of the knitting instrumentalities. The needle selection and actuating mechanism includes stitch transfer devices for transferring stitches from one needle or needles to the adjacent needle or needles to form tapered or contoured knit products which are seamless and smooth.

A constant tension yarn feed mechanism is provided for feeding yarn to the needles at extremely low tension, even below the tension required to draw yarn from the package. A yam tensioning and dispensing system described in U.S. Pat. No. 4,025,026, incorporated herein by reference, is admirably suited for use with the flat bed knitting machine of the present invention. The specialized means by which this tension control device is powered in this application, and the manner in which it is connected to and controlled by the knitting machine computer allows the yarn tension to be selectively altered and adjusted from one stitch to the next, thereby expanding the range and accuracy of stitch size control which the knitting machine can automatically effect when knitting with any yarn, particularly highly elastic covered spandex yams. Also this yarn tension control system allows yarn to be absorbed back from the yarn positioning mechanism into the tensioning device without tension variations thereby allowing the necessary freedom of movement for the yam guiding tip to accomplish the plurality of multi-dimensional moves to form the required knitted structures.

BRIEF DESCRIPTION OF THE DRAWINGS

The foregoing and other objects and advantages of the invention, and the manner in which the same are accomplished, will be more readily understood when taken in conjunction with the accompanying detailed description and drawings in which.

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figures 1, 4:
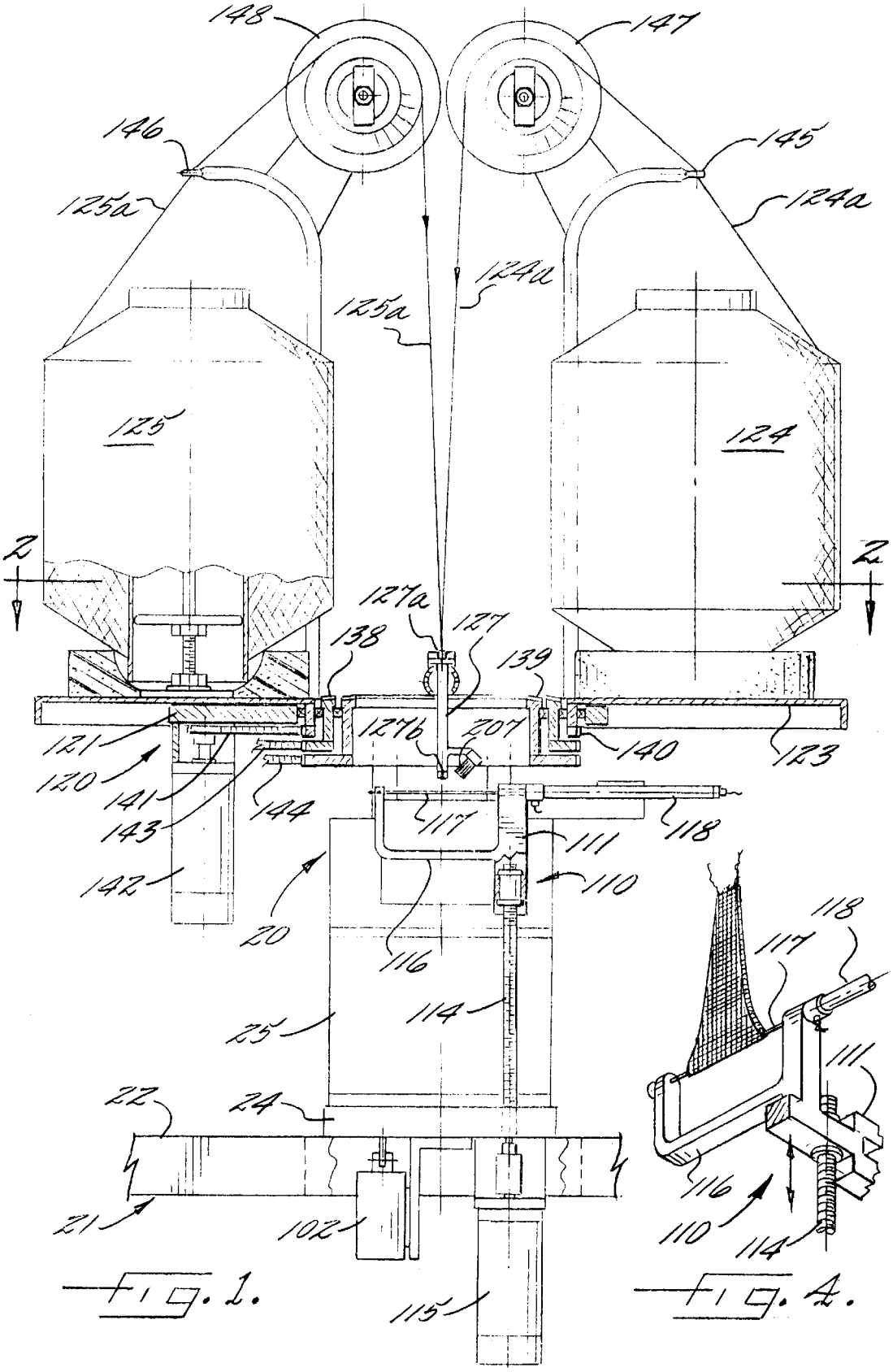
FIG. 1 is a fragmentary vertical sectional view of a flat bed knitting machine incorporating the features of the present invention.
FIG. 4 is a fragmentary perspective view of the fabric takedown mechanism shown in the medial area of FIG. 1.
Figure 2:
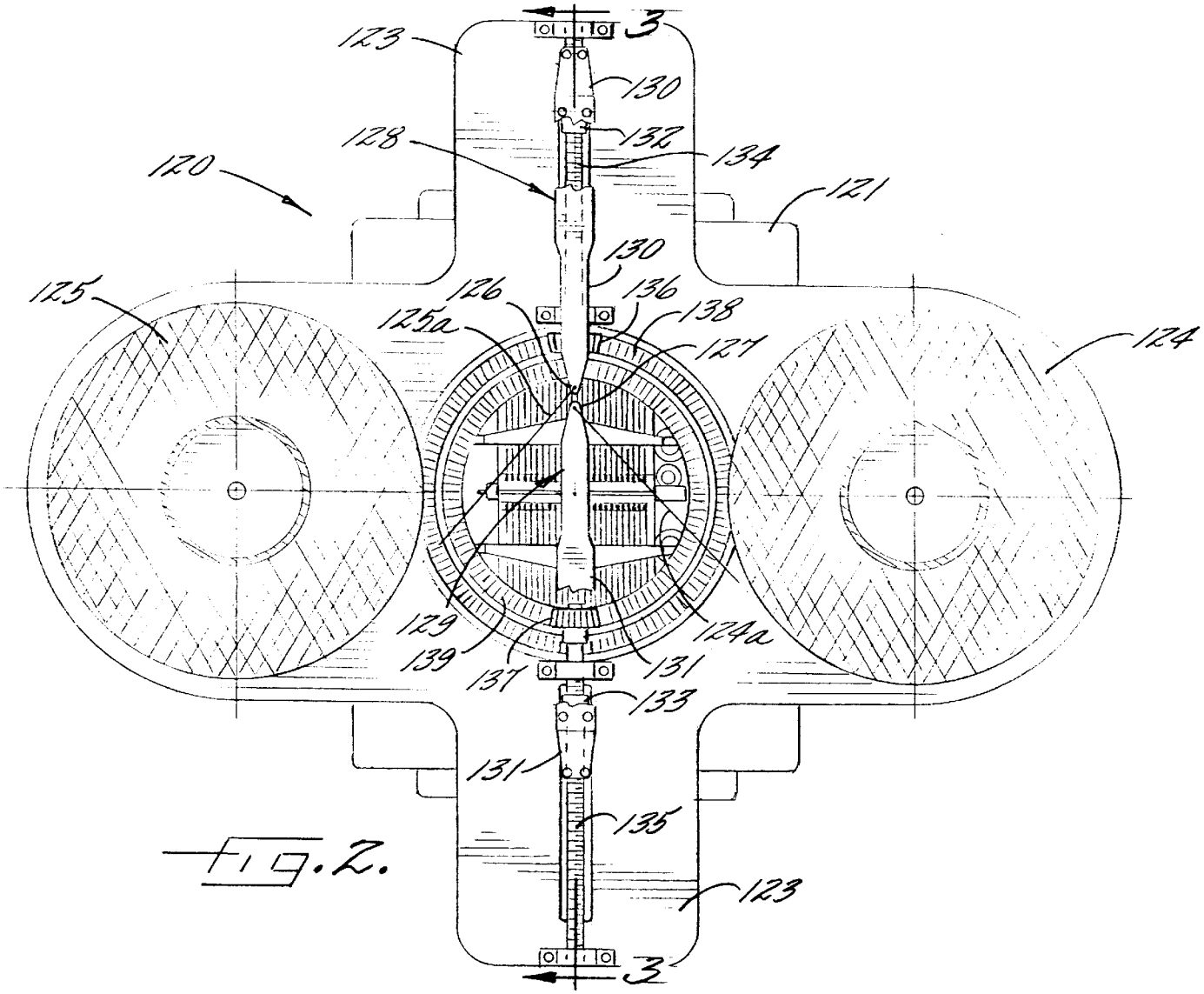
FIG. 2 is a horizontal sectional view taken substantially along line 2—2 in FIG. 1.
Figure 3:
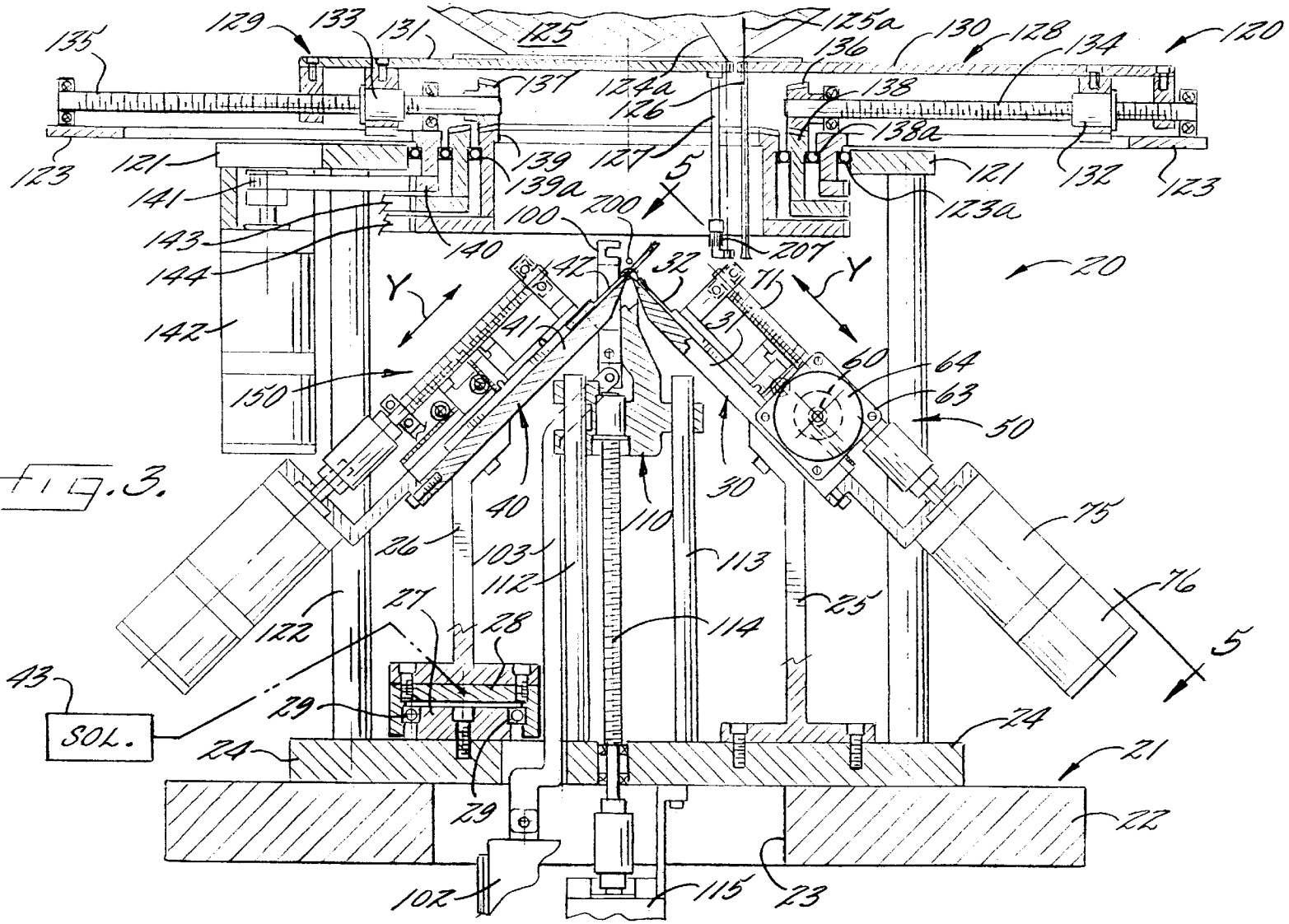
FIG. 3 is a fragmentary vertical sectional view taken substantially along line 3—3 in FIG. 2.

Referring now more particularly to the drawings, and specifically to FIGS. 1–3, there is illustrated a flat bed knitting machine, generally indicated at 20, incorporating the features of the present invention. Knitting machine 20 includes a base 21 which is supported on a pedestal or other machine support (not shown). Base 21 includes a lower base plate 22 having a central opening 23 therethrough. Lower base plate 22 supports an upper base plate 24.

A first pedestal 25 is fixedly mounted on upper base plate 24 and extends upwardly therefrom. A second pedestal 26 is movably mounted on upper base plate 24 by a first plate 27 fixed to upper base plate 24 and a second plate 28 slidably mounted on first plate 27 by bearings 29 and carrying second pedestal 26 thereon (FIG. 3).

Figure 7:
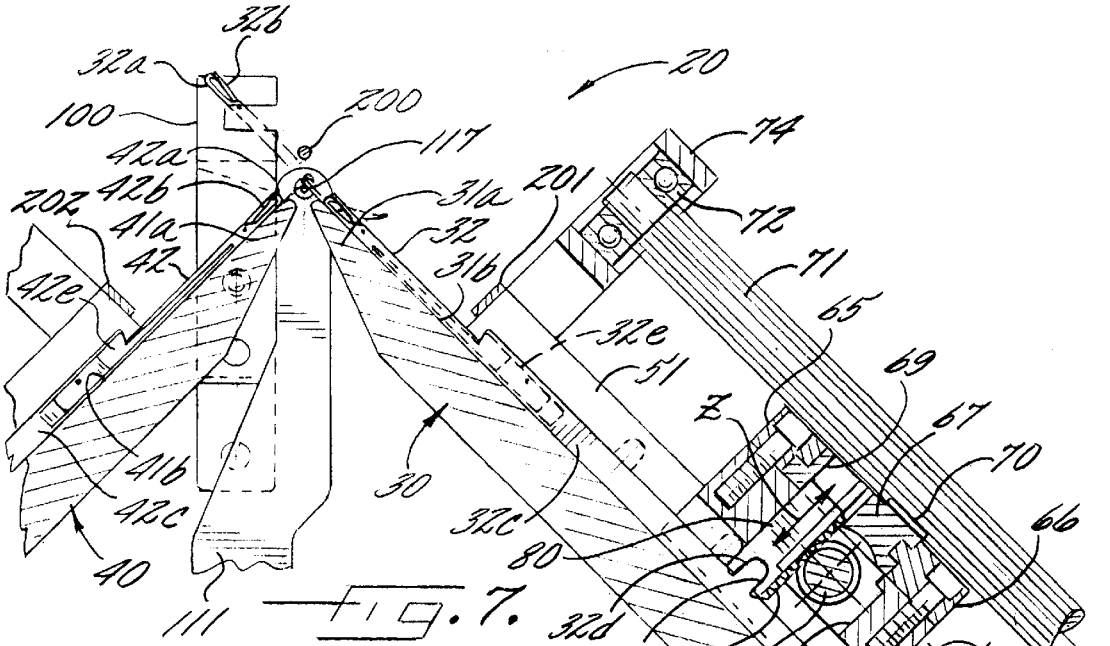
FIG. 7 is an enlarged, fragmentary sectional view taken substantially along line 7—7 in FIG. 5.

A first needle bed, generally indicated at 30, is fixedly mounted on top of first pedestal 25 at substantially a 45° angle to horizontal. First needle bed 30 includes a flat plate 31 having an upper end 31a (FIG. 7). Plate 31 has a multiplicity of parallel needle grooves 31*b* in its upper surface. Needle grooves 31*b* are preferably undercut for at least a portion of their length from the lower ends thereof to a medial location to assist in holding needles in grooves 31*b* and are open at their upper ends at upper end 31 a of plate 31. A knitting needle 32 is slidably mounted in each needle groove 31*b* in needle bed plate 31 and has a hook 32*a* at its upper end, a latch 32*b* pivotally mounted on the upper end of shank 32*c* for cooperation with the hook 32*a* and an actuating butt 32*d* at a medial location on shank 32*c*. Needles 32 may be any suitable standard latch needle with a stitch transfer pocket 32*e*, of which Groz-Beckert Vosa Spec. 104.58–50 G01 is one example. Also, the number of needle grooves 31*b* and of needles 32 may be of any desired amount, such as fifty (50). Similarly, the spacing between adjacent grooves 31*b* and therefore, between adjacent needles (i.e. "needle pitch") may be as desired, such as 0.057 inches.

A second needle bed, generally indicated at 40, is fixedly mounted on top of second pedestal 26 at substantially a 45° angle to the horizontal. Second needle bed 40 includes a flat plate 41 having an upper end 41*a* and a multiplicity of needle grooves 41*b* in its upper surface. Needle grooves 41*b* are identical in size, number, spacing and shape as needle grooves 31*b* in plate 31. A needle 42, identical to needle 32, is slidably mounted in each of the needle grooves 41*b* and has a hook 42*a*, a latch 42*b*, a shank 42*c*, an actuating butt 42*d* and a stitch transfer pocket 42*e* (FIG. 7). The grooves 41*b* and needles 42 in bed 40 are disposed in off-set relation to the grooves 31*b* and needles 32 in bed 30 by one-half of the needle pitch so that the needles 32 and 42 may be extended without colliding with each other. Also, bed 40 is movable laterally relative to bed 30 by one needle pitch. Such lateral movement or shifting of bed 40 is effected by a linear solenoid 43 connected to plate 28 at the base of second pedestal 26 (FIG. 3).

Figure 5:
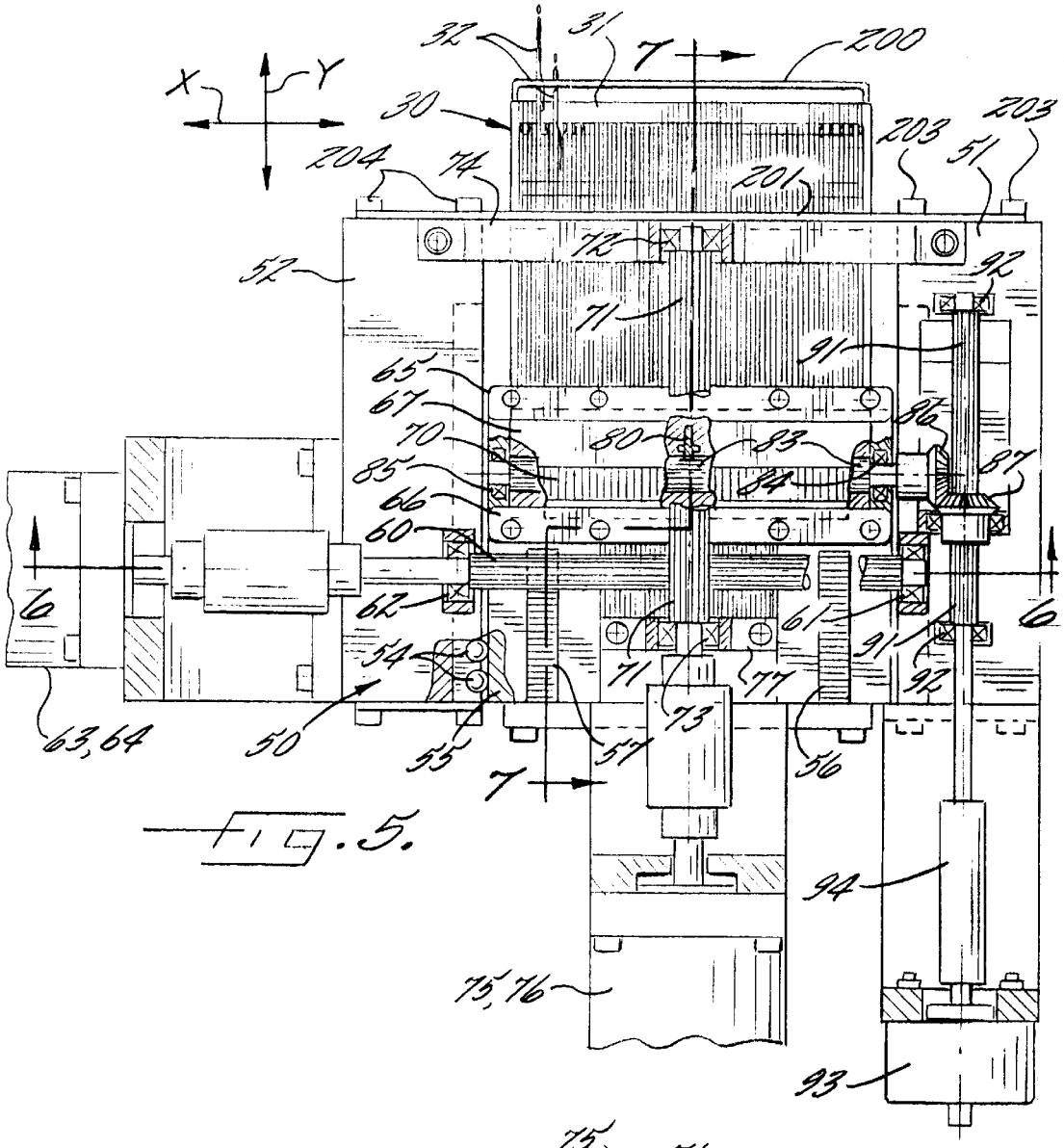
FIG. 5 is a fragmentary sectional view taken substantially along line 5—5 in FIG. 3 and with portions broken away for clarity.
Figure 6:
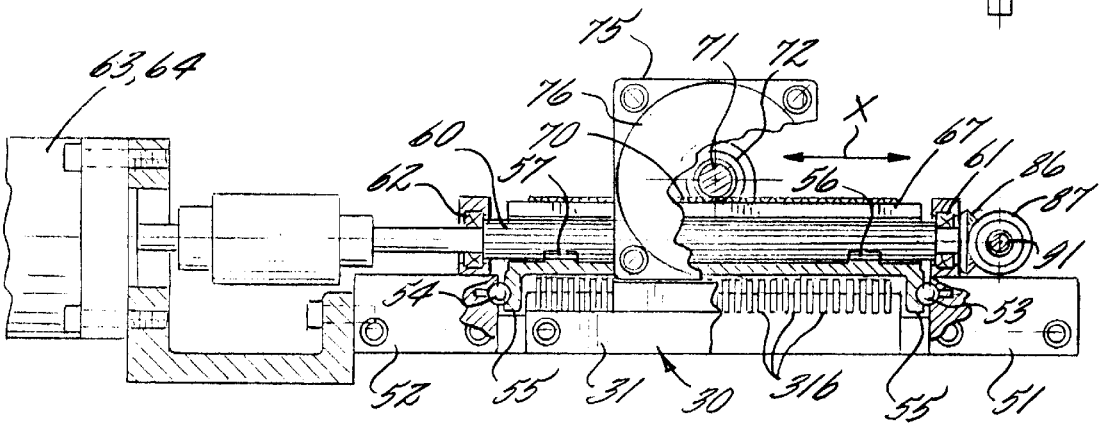
FIG. 6 is a fragmentary sectional view taken substantially along line 6—6 in FIG. 5 and with portions broken away for clarity.

A needle selection and actuating mechanism, generally indicated at 50, is mounted on the needle bed 30 and includes first and second track members 51 and 52 mounted on opposite sides of plate member 31 of needle bed 30 (FIGS. 5 and 6). Track members 51 and 52 have bearings 53, 54 thereon which support a main carriage 55 for sliding movement parallel to the needles 32. Carriage 55 bridges over the grooves 31*b* and needles 32 and, in its retracted position, extends from the lower end of plate 31 to approximately the middle thereof (FIGS. 5 and 7). Carriage 55 includes first and second rack gears 56 and 57 formed integral with or fixedly mounted on the upper surface of carriage 55 (FIGS. 5 and 6). A spline gear 60 meshes with rack gears 56 and 57 and is journaled for rotation in radial bearings 61, 62 mounted on track members 51, 52, respectively. Spline gear 60 is driven in rotation by a servo motor 63 and an encoder axis drive means 64 (FIGS. 5 and 6) and through rack gears 56, 57 causes carriage 55 to reciprocate upward and downward parallel to the needle bed 30.

Carriage 55 supports first and second track members 65, 66 which extend transversely thereof on opposite sides of a transversely extending opening 58 in carriage 55 (FIG. 7). A picker carriage 67 is slidably mounted on track members 65, 66 for movement perpendicular to the movement of needles 32 and of carriage 55. Picker carriage 67 has a rack gear 70 integral with or fixedly mounted on the upper surface thereof which meshes with a spline gear 71 journaled for rotation in bearings 72, 73. Bearing 72 is mounted on a cross member 74 extending between and supported at its opposite ends on track members 51, 52 and bearing 73 is supported on plate member 31 by a bracket 77. Spline gear 71 is driven in rotation by a servo motor 75 and an cencoder axis drive means 76.

Figure 8:
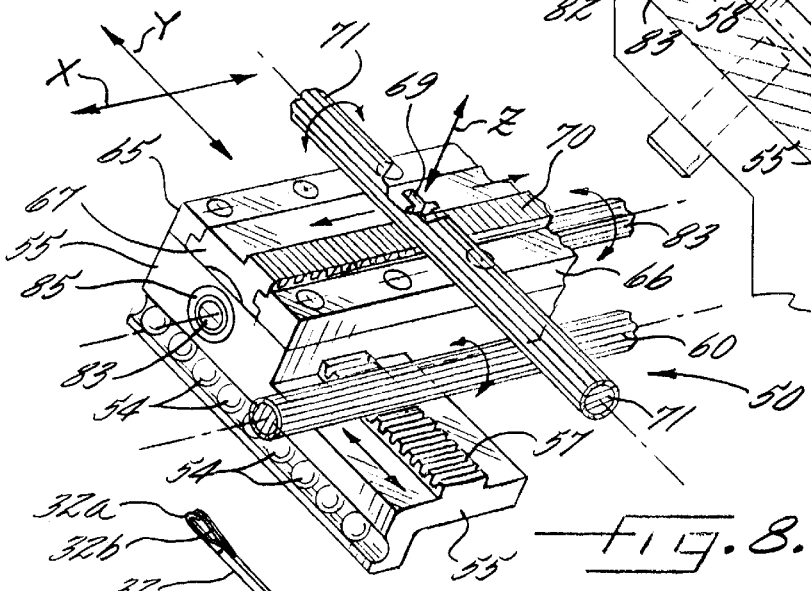
FIG. 8 is an enlarged, fragmentary perspective view of a portion of the needle selection and actuating mechanism shown on the right-hand portion of FIG. 7.
Figure 9:
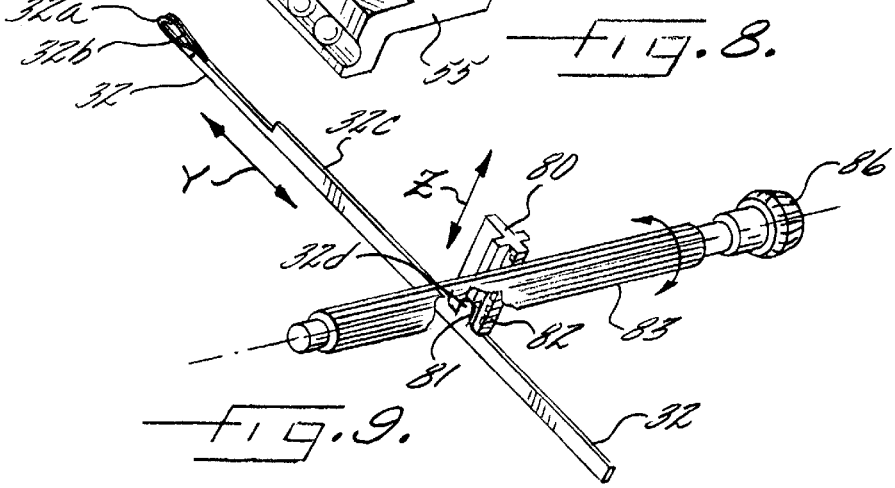
FIG. 9 is an enlarged, fragmentary perspective detail of a needle and needle selection mechanism shown in FIG. 7.

Picker carriage 67 has a cross-shaped hole 69 therein, in which is mounted for vertical sliding or reciprocatory movement a picker 80 which has a corresponding cross-shape in cross-section (FIGS. 8 and 9). The lower end of picker 80 has a cavity 81 which has a shape corresponding to the shape of the actuating butt 32*d* on shank 32*c* of needle 32 so that the actuating butt 32*d* is snugly received in cavity 81 when picker 80 is lowered onto a selected needle 32. The rear face of picker 80 has a rack gear 82 integral with or fixedly mounted thereon and which meshes with a spline gear 83. Spline gear 83 is journaled for rotation in bearings 84, 85 supported by carriage 55 and has a bevel gear 86 mounted on the outer end thereof. Bevel gear 86 meshes with a bevel gear 87 mounted in a four point contact ball bearing 90 and having internal teeth meshing with a cleven-tooth spline gear 91 which penetrates through the bevel gear 87 and is journaled for rotation in bearings 92 mounted on track member 51. Spline gear 91 is driven in rotation by an electromagnetic rotary actuator 93 through a connector 94 (FIG. 5).

A needle selection and actuating mechanism, generally indicated at 150, identical to needle selection and actuating mechanism 50, is provided on needle bed 40 for selecting and actuating needles 42. Since the structure and operation of needle selection and actuating mechanism 150 is the same as needle selection and actuating mechanism 50, needle selection and actuating mechanism 150 will not be described herein but reference to the foregoing description of needle selection and actuating mechanism 50 should be made for a description thereof.

A yarn cutter-gripper 100 is mounted at one side of the needle bed 40, near the knitting verge of the needles 32, 42 for capturing, holding and cutting the yam forming the knit product (FIGS. 3 and 5). A similar yarn cutter-gripper (not shown) is mounted at the opposite side of needle bed 30 for the same purpose. The yarn cutter gripper 100 is moved vertically to capture and cut the yarn by a solenoid 102 connected to the cutter-gripper 100 by a connecting link 103 (FIG. 3).

Knitting machine 20 also includes a fabric takedown mechanism, generally indicated at 110. Take-down mechanism 110 includes a take-down carriage 111 mounted for vertical reciprocating movement on a pair of cylindrical posts or columns 112, 113 supported by plate 24 of base 21. Takedown carriage 111 is connected to a lead screw 114 which is rotated by a computer controlled rotary axis drive 115 to move carriage 111 vertically. Takedown carriage 111 carries a c-shaped bracket 116 having an extensible and retractable wire 117 thereon for penetrating through the lower end of the knit product, as shown in FIG. 4. A small air cylinder 118 is connected to wire 117 for extending and retracting the same.

Figure 13:
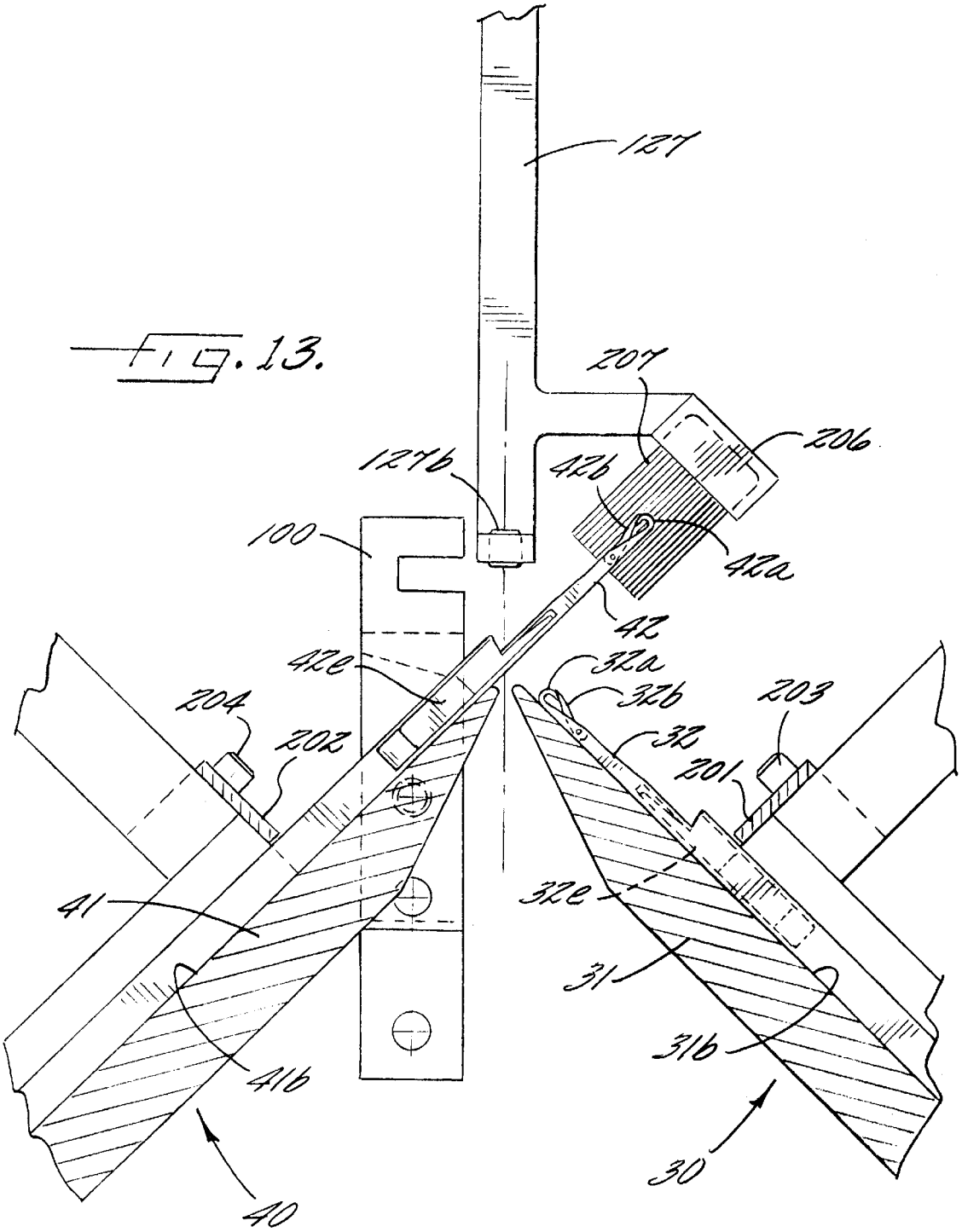
FIG. 13 is an enlarged, fragmentary elevational view of the latch opening mechanism of the knitting machine of the present invention.

Knitting machine 20 further includes a yarn supply and feeding mechanism, generally indicated at 120. Yarn supply and feeding mechanism 120 includes a platform 121 supported on base plate 24 by a plurality of posts or columns 122 (FIGS. 2 and 3). Platform 121 supports a deck 123 for rotation thereon by a bearing or bearings 123*a*. Deck 123 carries two yarn packages, 124, 125 and yarn trumpet 126, which has upper and lower ceramic yarn guides (not shown). Deck 123 also carries a bracket 127 which depends downwardly therefrom in spaced relation to yarn trumpet 126 and which has upper and lower ceramic yarn guides 127*a*, 127*b* (FIGS. 1 and 3), only the lower 127*a* of which is shown in FIG. 13.

At the lower end of bracket 127, there is positioned, at substantially 45° to the horizontal plane, a brush element 180 (FIG. 13) which is reciprocated along the top of the row of needles 32, 42 when raised to open the latches 32*b*, 42*b* thereof. Yarn trumpet 126 and bracket 127 are mounted on traverse mechanisms 128, 129, respectively, which include slidably mounted yarn feed member carriers 130, 131. Carriers 130, 131 are attached to followers 132, 133, respectively, mounted on lead screws 134, 135 (FIG. 3), which operate to move yarn trumpet 126 and bracket 127 along a common radial path of travel. Lead screws 134, 135 have bevel gears 136, 137 respectively mounted on the inner ends thereof and which mesh, respectively with bevel gears 138, 139 rotatably mounted on deck 123 by bearings 138*a* and 139*a* (FIG. 3).

Deck 123 is rotated by a gear or sprocket 140 mounted thereon about which a chain or timing belt 141 is trained and which is driven by a servo motor 142 (FIGS. 1 and 3). Similarly, bevel gears 138 and 139 are rotated by chains or timing belts 143 and 144 trained thereabout and driven by servo motors (not shown).

Figure 10:
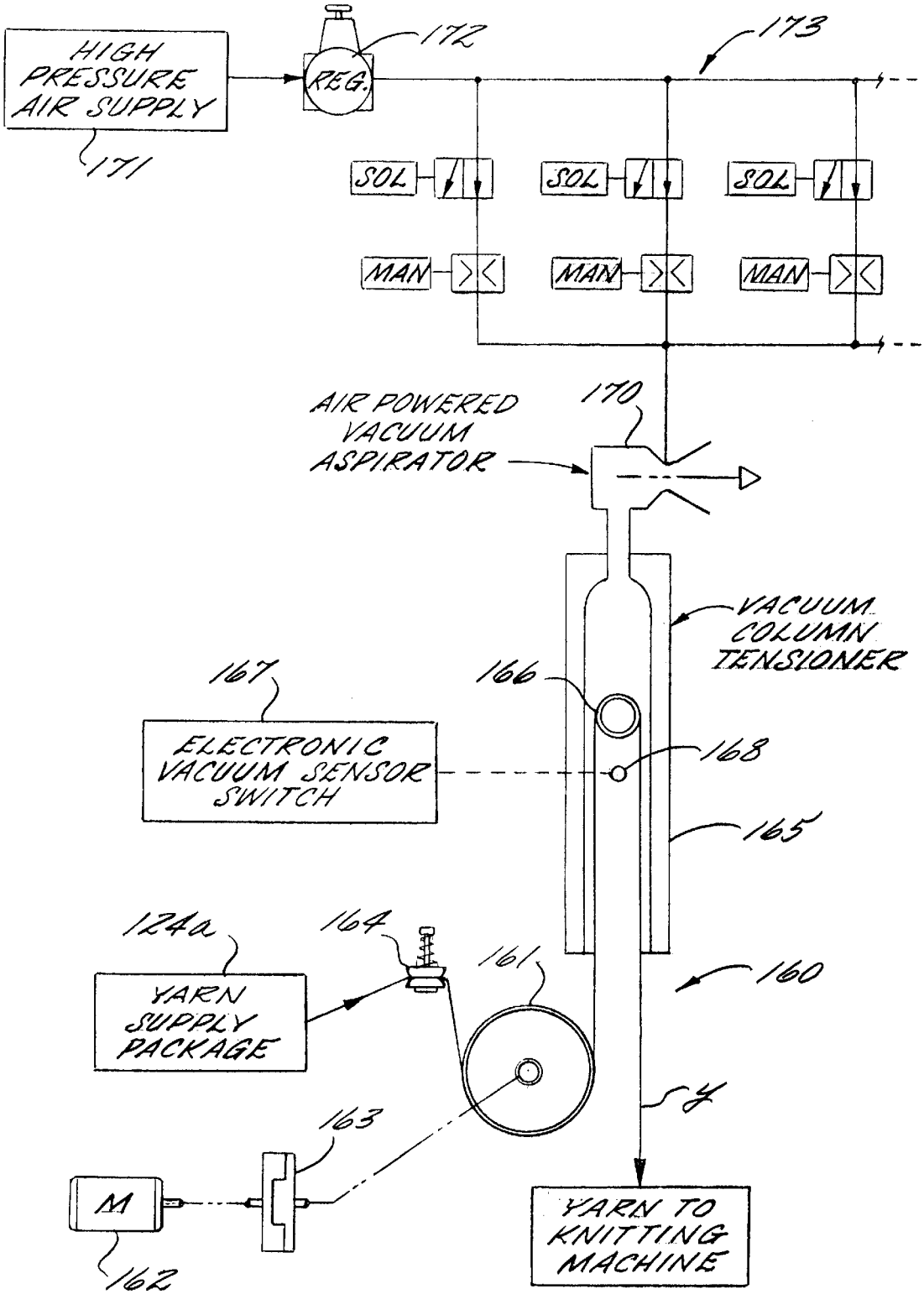
FIG. 10 is a schematic view of a vacuum tensioner for use in the flat bed knitting machine of the present invention.

The yams 124*a* and 125*a* from packages 124 and 125 pass through yarn guides 145, 146 to positive yarn feed means 147, 148 and thence to the yarn trumpet 126, yarn guides 127*a*, 127*b* on bracket 127 (FIG. 1). The yarn feed means 147, 148 may be conventional disk tensioners and may be used in some instances. However, the tensioner described in detail in U.S. Pat. No. 4,025,026, previously incorporated herein by reference, as modified, as shown in FIG. 10 hereof, is preferred. The vacuum tensioner, generally indicated at 160, includes a yarn feed roll 161 which is driven by a suitable motor 162 through a fast acting electromechanical clutch-brake mechanism 163. A conventional disk tension device 164 is positioned between the yarn package 124 or 125 and the yarn feed roll 161.

Tensioner 160 further includes a vacuum column 165 having a floating puck or hoop 166 around which the yarn Y is trained. A sensitive electronic pressure switch 167 is connected to a sensor port 168 in vacuum column 165 and is coupled to electromechanical clutch-brake 163. An air powered vacuum aspirator 170 is connected to the top of vacuum column 165. Aspirator 170 is connected to a high pressure air supply 171 through a pressure regulator 172 and a solenoid operated valve control means, generally indicated at 173. Control means 173 includes respective needle valves 174, 175 and 176, each pair of which is connected to the precision regulator 172. One of the pair of needle valves is in series with a two-way solenoid valve 177, 178 and 179. If only one of the associated solenoid valves 177, 178 and 179 is actuated, then compressed air enters aspirator 170 and creates the lowest pressure to the aspirator 170 and hence the lowest vacuum to the column 165, resulting in a yarn tension of two to three grams. If two or more of the solenoid valves 177, 178 and 179 are opened, the level of vacuum is increased, and the supply tension rises to a level of up to five grams. More than two levels of tension may be obtained by choosing different combinations of these valves.

Figures 11, 12:
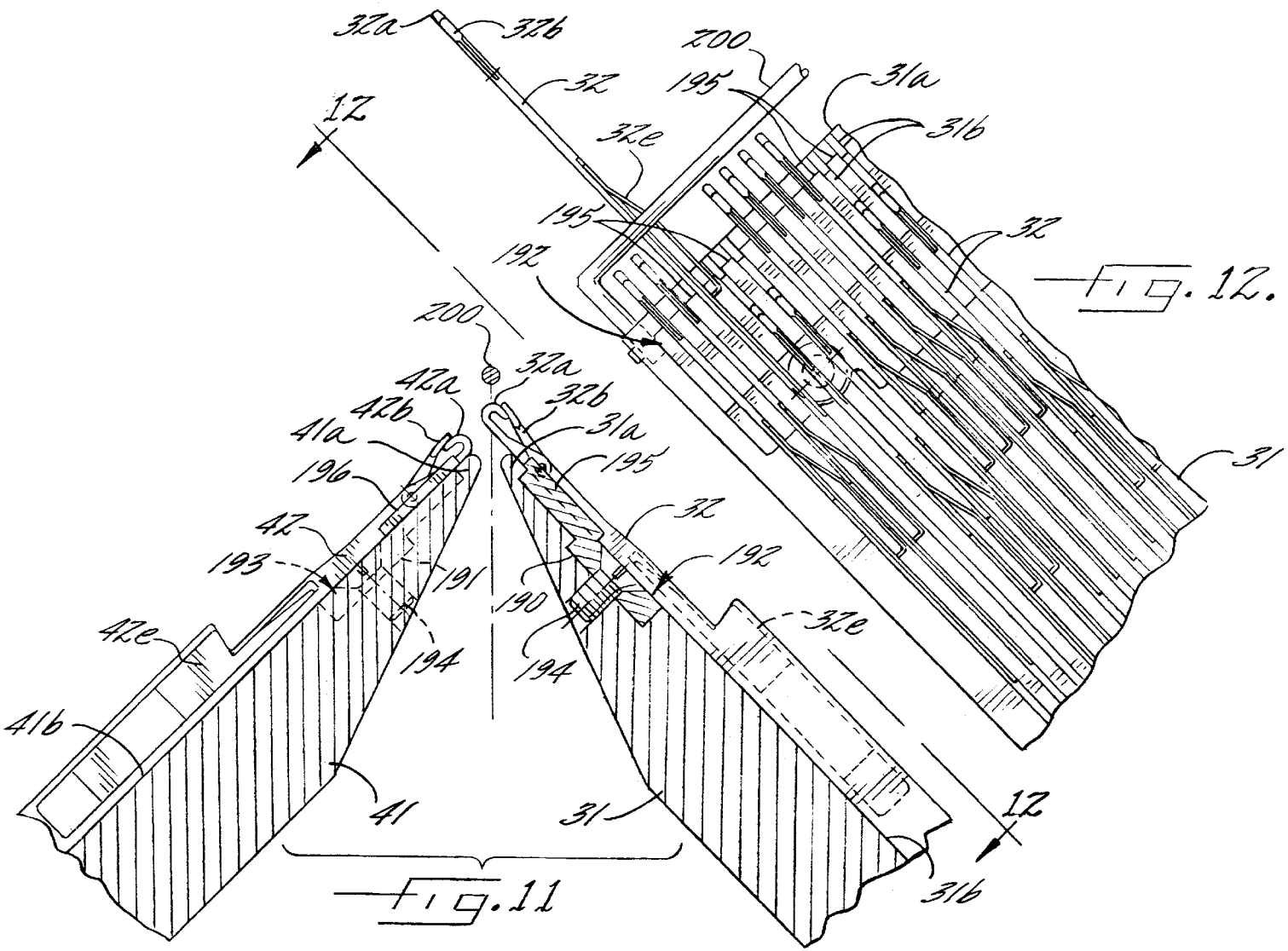
FIG. 11 is a fragmentary, schematic view similar to FIG. 7 of another embodiment of the knitting machine of the present invention.
FIG. 12 is a fragmentary, schematic plan view of the needle bed shown in FIG. 11.

Referring now to FIGS. 11 and 12, there is illustrated another feature of the present invention that assists in the production of a flat, uniform knit fabric, particularly when that fabric is knit from spandex yarns. As illustrated, the needle beds 30 and 40 have recesses or pockets 190, 191 machined into the upper surfaces of needle plates 31 and 41 and extending completely across the banks of needles 32, 42. Inlaid plates, general indicated at 192, 193, are mounted in the pockets 190, 191 by screws 194. Inlaid plates 192, 193 are preferably formed of highly wear resistant, heat-treated, tool steel, such as CPM10V or D-2.

The upper surfaces of the inlaid plates 192, 193 have spaced apart, upstanding ribs or microverges 195, 196 preferably formed integrally therewith. Microverges 195, 196 are positioned between needle grooves 31*b* and 41*b*, respectively, and are of a height such that the transfer pockets 32*e*, 42*e* readily pass over the top thereof during reciprocation of the needles 32, 42. Also, the upper corners of the microverges are preferably square to better grip and retain the already formed stitches on the needles 32, 42. In addition to positioning and controlling previously formed stitches during subsequent stitch formation, the microverges 195, 196 serve to stabilize and prevent bending or other lateral movement of the needles 32, 42 during reciprocation thereof. This is particularly important with the outermost needles 32, 42 because of the lateral force applied thereto by the fabric take-down mechanism 110.

Also, illustrated in FIG. 11 is a latch guard 200 which is positioned centrally between and above the knitting verges of needle bed plates 31 and 41 and adjacent but above the paths of travel of the needle hooks 32*a*, 42*a*. The latch guard 200 is suitably mounted in fixed position on the needle bed 30 (FIG. 12) and prevents the latches 32*b*, 42*b* from closing when previously formed stitches on the needles 32, 42 clear the tips of the latches 32*b*, 42*b* and when the needles 32, 42 are accelerated downward from raised positions.

Needle clamp bars 201, 202 are mounted on the upper ends of track members 51, 52 on needle bed 30 and on the corresponding track members (not shown) on needle bed 40, by cap screws 203, 204 (FIGS. 5 and 7). These clamp bars 201, 202 are disposed above needles 32 and 42 and prevent such needles from raising up out of the needle grooves 31*b*, 41*b* in plates 31, 41.

The operation of knitting machine 20 will now be described. For brevity and simplicity, such operation will be described in connection with the knitting of a tapered, tubular knit product, closed at both ends. It should be understood that such operation is exemplary only and should not be considered as limiting.

To commence the knitting of such a product, yarn deck 123 is rotated such that the motion of yarn feed member 126, by actuation of lead screw 134, is perpendicular to the needles, when the yarn feeder 126 is aligned at the mid plane between the two needle banks. The yarn 124*a* is cut and held by the cutter-gripper 100. Then, the stored pattern selects all of needles 32, 42 to be used in knitting the tapered knit product. The needle selection and actuating mechanisms 50 and 150 move first the needles 32, to the highest position and the latches 32*b* thereof are opened by traversing the brush element 180 on the end of bracket 127 across the bank of raised needles 32. Such traversal causes the bristles of the brush element 180 to move over the convex surfaces of the needle hooks 32*a* and to slide between the closed latches 32*b* and the needle hooks 32*a* thereby pivoting the latches 32*b* away from the hooks 32*a* and forcing the latches 32*b* against the needle shanks 32*c*. Then, the needles 32 are lowered slowly to a position where the tops of the hooks 32*a* thereof are level with the knitting verges. The slow movement is to ensure that the opened latches 32*b* do not move back to the closed position. This latch opening procedure is then repeated for the other bank of needles 42.

If the first course is at the widest end of the tapered knit product, all of the needles 32, 42 to be used in knitting the first course are raised to the upper lacing position, the yarn 124*a* (its free end captured by the yarn cutter and gripper 100) is then moved into position by yarn trumpet 126 to be captured by the hook 32*a* of the first needle 32 in needle bed 30 which has been raised to the lower transfer position. This first needle 32 is then lowered to the intermediate lace position which draws the yarn downward to a level just above the knitting verges. Then, the first needle 42 in needle bed 40 is raised to the lower transfer position and the yarn feed member 126 moves the yarn 124*a* into position to be captured by the hook 42*a*. Needle 42 is then lowered to the intermediate lace position. This lacing procedure is continued, alternating between the needle banks, until all of the needles 32 and 42 have yarn 124*a* laced thereabout in a zig-zag manner between the needle banks 32 and 42. It is preferable for several needles 32 and 42 near each end of the active needle banks to be raised and lowered at least twice to form double or multiple lacings about these needles for greater strength at the corners of the knit product.

The lacing of the needles has now been completed and all of the laced needles 32 and 42 are now moved to the lower lacing position thereby stretching the laced loops and exposing a labyrinth of yarn between the hooks 32*a*, 42*a* of the two banks of needles 32 and 42. Take-down mechanism 110 is then elevated to its uppermost position by the computer control system (not shown), causing the rotary axis drive means 115 to rotate lead screw 114 in the appropriate direction. The wire 117 is extended by the air cylinder 118 so that wire 117 is above the laced yarn 124*a*. The take-down mechanism 110 is then lowered until the laced yarn 124*a* is in contact with the knitting verges.

The knitting of the first course of the knit product can now proceed and this is performed by raising the needles 32 sequentially to the upper knitting position at which the laced loops clear the tips of the opened latches 32*b* and move onto the shanks 32*c* of the needles 32 and the needles 32 are then lowered to the wrap or yam feed position where the cleared loop is underneath the latches 32*b*. The yarn trumpet 126 is moved by the lead screw 134 and carrier member 130 perpendicular to the raised needles 32 such that yarn 124*a* is laid across the needles 32 below the hooks 32*a*, and above the tips of the opened latches 32*b*. The needles 32 are then sequentially lowered, whereby the hooks 32*a* thereof capture the yarn 124*a*, to the lower knit or stitch forming position to draw or form sequentially the stitch loops of the first course. Since each needle 32 is preferably moved individually and independently to the lower knit or stitch forming position by the needle selection and actuating mechanism 50 before it is released by the picker 80, which then is moved to the next adjacent needle 32, each stitch loop is completed before the next needle 32 is moved upwardly to the upper knitting position initiating the formation of the next stitch loop in that first course.

Stitch formation by the needles 32 continues until stitch loops have been formed by all of the active needles 32 in that needle bank. The formation of stitch loops by the needles 42 in the other needle bank is then initiated by causing the needle selection and actuating mechanism 150 to raise all of the active needles 42 to the upper knitting position and then to the yarn feed position. The yarn feed member 126 is then moved to lay the yarn 124*a* across the active needles 42 as described with needles 32 above. The needle selection and actuating mechanism 150 then selects the needle 42 immediately adjacent to last needle 32 in the needle bed 30 which has formed a stitch loop and to lower it to the lower knit or stitch forming position to form a stitch thereon. Stitch formation continues sequentially until all of the active needles 42 have formed stitch loops which completes the first course of the knit product.

At that time, the stitch loop formation is returned to needle bank 32 and proceeds until a predetermined number of initial courses, e.g. four, have been knit. Then, the yarn cutter and gripper 101 is caused to release the free end of yarn 124*a* so that the take-down mechanism 110 can be lowered without undue resistance, to take down the knitted fabric until the knit product is completed.

It might be well at this point to digress to describe in some detail the operation of the needle selection and actuating mechanisms 50 and 150. Since they are identical, only the operation of needle selection and actuating mechanism 50 will be described.

The pattern stored in the computer control system (not shown) determines which needles 32 are to be selected for actuation and to which location or position the selected needle 32 is to be moved. Since the needle selection and actuating mechanism 50 under its computer control system is an interactive system, the precise extent of movement and stopping point thereof may vary in accordance with knitting parameters as these may vary or occur so that the knit product has the characteristics desired.

The computer control system, in accordance with the stored pattern, actuates the servo motor 75 and drive 76 to rotate spline gear 71 to move picker carriage 67 by way of rack gear 70 to a position at which picker 80 is directly above the selected needle 32. Carriage servo motor 63 and drive 64 is actuated to rotate spline gear 60 to move carriage 55 by way of rack gears 56 and 57 to the proper position to align picker 80 with the actuating butt 32*d* of the selected needle 32. Since the computer control system has stored the exact position at which this particular needle 32 was left when last it was moved, this movement of carriage 55 can be effected without lost motion and very quickly. Then, the control system actuates the electromagnetic rotary actuator 93 to rotate picker spline gear 83 by way of spline gear 91 and bevel gears 87 and 86. This lowers picker 80 to capture butt 32*d* in cavity 81.

The control system then actuates servo motor 63 to move carriage 55 upwardly parallel to needle bed 30 by rotating carriage spline gear 60 to move the selected needle 32 between the various desired positions, such as raising the needle 32 to the upper knitting position, lowering it to the wrap position and then lowering it to the lower knit or stitch forming position. In accordance with the preferred embodiment of this invention, once the selected needle 32 has been moved to the last of its positions in accordance with the pattern, the picker 80 is moved upwardly to release the butt 32*a* and the next needle selection and actuation is initiated. One of the many benefits of the present invention is the versatility and adaptability of the needle selection and actuation mechanism 50. Various and sundry other needle actuation sequences will undoubtedly occur readily to persons skilled in the knitting art without deporting from the spirit and scope of this invention.

Returning to the description of the knitting of the tapered knit product, once the predetermined number of initial courses have been knit, the tapering function is initiated at opposite ends of the two needle banks and is accomplished by transferring the loops of yarn from at least the outermost needles 32, 42 in the needle banks to the next adjacent needles 42, 32 on the opposite banks. The first step in the stitch transfer is to raise the receiving needle, e.g. needle 32, to a tuck position and then lower it to a press off position. This action opens the latch 32*b* on the receiving needle 32 and leaves the latch open to receive the transferred stitch. Next, the needle from which the stitch is to be transferred (i.e. giving needle), such as needle 42, is raised to an upper transfer position which slides the stitch thereon tightly against the corner of the transfer pocket 42*e* (FIG. 7). The giving needle 42 is then lowered to a lower transfer position which allows the receiving needle 32 to enter the back of the transfer pocket 42*e* above the location of that side of the loop around the transfer pocket 42*e* as the receiving needle 32 is raised to the yarn division position. The giving needle 42 is then raised to the upper stitch transfer position so that the receiving needle 32 will divide the yarn and the lower portion of the loop goes under the back side of the receiving needle hook 32*a* and the top portion goes over the hook 32*a*. The receiving needle 32 is then raised to the tuck position in which both the loop which was already on the receiving needle 32 and the loop being transferred are both over the latch 32*b* and under the hook 32*a* of the receiving needle 32. The giving needle 42 is then lowered to the press off position, which closes its latch 42*b* and allows its stitch to remain under the hook 32*a* of the receiving needle 32. Finally, the receiving needle 32 is lowered to the press off position and both stitches rise up Linder its hook 32*a*. The next time the receiving needle 32 is raised to the upper knitting position, both stitches move off the open latch 32*b* onto the shank 32*c* and the new stitch being formed is drawn through both stitches. The transfer of a stitch from the end needle 42 of one needle bank onto the end needle 32 of the other needle bank which is located one-half needle pitch away is thus concluded and the giving needle 42 becomes inactive.

Normally, if the transfer at one end of the needle banks is from the needle bank 42 to the needle bank 32, then the transfer at the other end of the needle banks will be from the needle bank 32 to the needle bank 42. Therefore, if there are, for example, fifty (50) needles active in each bank, needles one through forty-nine would be active after the transfer in one bank and needles two through fifty would be active in the other bank.

In some instances, it may be desirable to follow the above transfer of stitches from one bank to the other with an immediate additional transfer back to the next adjacent needle in the original bank. To effect this double transfer, the same needle movements as described above are performed except that the needle bank 42 is shifted laterally one needle pitch before the first transfer at one end of the needle banks and after the first transfer at the other end of the needle banks. After this double transfer, under the above example, needles two through forty-nine on both banks would be active.

After each stitch transfer function is completed, a predetermined number of courses are knit on the then active needles in each bank. Then, the next stitch transfer or tapering function is effected until the tapered knit product is completed.

If the first course is at the narrowest end of the tapered knit product, then a sufficient number of needles 32, 42 in the needle banks are selected and are laced as described herein before. The first course and a predetermined number of initial courses are then sequentially knit, e.g. a total of four courses, and then widening is commenced. Widening is accomplished by adding one needle at each end of the active needles 32, 42. As before, once needles 32, 42 are added, a predetermined number of courses are knit on the then active needles before additional needles are added and this process continues until the tapered knit product is completed.

The size of stitches formed by knitting machine 20 is directly dependent upon the tension in the knitting yarn, the depth of the needle draw, i.e. the amount of movement of the needles below the knitting verges to the lower knit or stitch forming position, and the tension in the knit fabric being taken down. Higher yarn tension produces smaller, tighter stitches, as do shorter or shallower needle draw positions and knit fabric tension, and vice versa.

The vacuum column tension system 160 derives its tension from a product of the differential pressure across the floating puck or hoop 166 and the cross-sectional area of the column 165. The differential vacuum pressure, generated by the aspirator 170, varies depending on the size and length of the stitches dictated by the pattern. The vacuum generated by aspirator 170 under control of the control means 173 dictates the position of the floating puck or hoop 166. If the puck 166 drops down to the sensor port 168, the electronic sensor switch 167 actuates the clutch-brake 163 to rotate feed roll 161 to feed the yarn at the desired tension.

It is usually desirable to have tighter stitches along the edges at opposite ends of the needle banks and in the final courses at the smaller end of the tapered knit product. Such tighter stitches can readily be accomplished by the apparatus of the present invention by increasing the tension in the yarn and decreasing the needle draw positions.

Stitch size is very difficult to maintain uniform, when knitting with 100% covered spandex yarns, by altering the force applied to the knit fabric being taken down. To overcome this problem and produce a course-by-course "check valve" like movement of the knit fabric, micro separators have been provided between the needles 32, 42 just below the knitting verges on the needle support plates 31 and 41. As each needle is raised to clear the stitch over the tip of the open latch, the previous course rises just enough to move over the end surfaces of the micro separators immediately adjacent that needle when that needle is lowered toward the stitch forming position, the micro separator holds the previous course in position so that the new stitch is pulled through the previous course which is always located at exactly the same position thereby negating or at least minimizing the effect of fabric tension on the stitch size. Therefore, if the yarn tension and needle draw positions are carefully regulated, all of the stitches will be of a predetermined, uniform size.

Once the last stitch in the last course of the tapered knit product is formed, the yarn feed member 126 is moved to a position adjacent the yam cutter and gripper 100 which captures and then severs the yarn. At this point, the last course is still attached to the active needles. These active needles are then raised sequentially to the upper knitting position and then lowered to the lower knit position without a yam being fed thereto. The last course is thusly released from the needles, although the first course of the tapered knit product is still attached to the take-down mechanism 110. The tapered knit product is released by actuating the air cylinder 118 to withdraw the wire 117 from the first course.

If desired, a suction transport system, or other transport means, can be provided for removing the finished tapered knit products. In such event, the take-down mechanism 110 is moved into association with a suction transport tube prior to releasing the knit product. The suction tube then receives the released knit product and transports it to a storage location.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments arc intended to be included within the scope of the appended claims. Although specific terms arc employed herein, they arc used in a generic and descriptive sense only and not for purposes of limitation.

That which is claimed:

1. A flat bed knitting apparatus for knitting ultra high quality, substantially defect free fabric from yarn comprising:

a pair of opposing flat needle beds arranged in operative relation, said needle beds having a multiplicity of parallel needle grooves in the upper surfaces thereof, said needle grooves being spaced apart a predetermined distance and the grooves in said opposing beds being offset by one-half of said predetermined distance, a latch needle mounted in each of said needle grooves in said needle beds for sliding movement between a plurality of positions, including an upper knitting position and a lower stitch forming position, means for selecting and actuating individual needles for movement between their various positions independently of any other needles and for varying the length of movement of the needles as required for substantially uniform stitch formation, and means for feeding a yarn to said needles under tension for substantially uniform stitch formation.

2. A knitting apparatus as claimed in claim 1 wherein said needle selection and actuating means completes the movement of an individual needle and thus the formation of a stitch prior to the selection and actuation of the next needle in that needle bed and thus prior to the commencement of the formation of the next stitch.

3. A knitting apparatus according to claim 1 wherein said yam feed means feeds the yarn to said needles at very low tension.

4. A knitting apparatus according to claim 1 wherein said needles have an actuating butt thereon and each of said needle selection and actuating means includes a picker sequentially movable into position overlying and into operative engagement with said needle actuating butt of needles selected for actuation and then movable to move the selected needle between various positions.

5. A knitting apparatus according to claim 4 wherein said picker is carried by a picker carriage mounted for movement above and parallel to said needle bed and perpendicular to the movement of said needles.

6. A knitting apparatus according to claim 5 wherein said picker is mounted on said picker carriage for movement toward and away from said needle bed to move into and out of engagement with said actuating butt on a needle.

7. A knitting apparatus according to claim 4 wherein said picker carriage is carried by a main carriage mounted for reciprocating movement above said needle bed and parallel to the movement of said needles.

8. A knitting apparatus according to claim 7 wherein said main carriage and said picker carriage are moved by variable drive means.

9. A knitting apparatus according to claim 8 wherein said variable drive means for said picker carriage includes a rack gear carried by said picker carriage, a rotatable spline gear meshing with said rack gear and a rotary axis drive connected to said spline gear for rotating said spline gear to move said picker carriage into proper position relative to the selected needle.

10. A knitting apparatus according to claim 8 wherein said variable drive means for said main carriage includes a pair of rack gears on said main carriage, a rotatable spline gear meshing with said rack gears and a rotary axis drive connected to said spline gear for rotating said spline gear to move said main carriage as required to position said picker carriage for needle selection and thereafter to move the selected needles between their various positions.

11. A knitting apparatus according to claim 6, including a rack gear mounted on said picker and extending perpendicular to said needle bed, a rotatable picker spline gear meshing with said rack gear and means for rotating said picker spline gear to move said picker into and out of engagement with the selected needles.

12. A knitting apparatus according to claim 1, including means for taking down the fabric being knitted in a manner consistent with uniform stitch formation.

13. A knitting apparatus according to claim 12 wherein said take-down means includes an extendable and retractable wire for penetrating a make-up course of laced yarn to connect said take-down means to the fabric.

14. A knitting apparatus according to claim 13 wherein said take-down means includes an air cylinder for extending and retracting said wire.

15. A knitting apparatus according to claim 13 wherein said take-down means includes a bracket carrying said wire and mounted for vertical movement, a rotatable lead screw connected to said bracket and a rotary axis drive connected to said lead screw for rotating said lead screw to raise or lower said bracket.

16. A knitting apparatus according to claim 1 wherein said needle selection and actuating means includes means for transferring stitches from giving needles on one needle bed to receiving needles on the other needle bed whereby said knitting apparatus knits a tapered knit product.

17. A knitting apparatus according to claim 16 wherein said needle selection and actuating means selects and actuates all of the active needles on one needle bed and thereafter selects and actuates all of the active needles on the other needle bed whereby a tubular tapered knit product is knitted.

18. A knitting apparatus according to claim 17 wherein said needle selection and actuating means raises and lowers the active needles on said needle beds sequentially and in alternation while said yarn feed means laces a yarn around said needles to form a make-up course to commence the knitting of the tubular tapered product and to close that end thereof.

19. A knitting apparatus according to claim 18 wherein said needle selection and actuating means shortens the movement of the active needles from the upper knitting position to the lower knitting or stitch forming position while said yarn feed means increases the tension in the yarn being fed to the needles to form shorter and tighter stitches in a predetermined number of courses at the tail end of the tubular tapered knit product being formed.

20. A knitting apparatus according to claim 19 wherein said needle selection and actuating means and said yarn feed means also cause said needles to form shorter and tighter stitches along opposite edges of the tubular tapered knit product.

21. A knitting apparatus according to claim 1, including a latch guard positioned between said needle beds and above the path of travel of said needles for preventing the latches on said needle from closing during acceleration of said needles downwardly and during movement of said needles upwardly to the upper knitting position.

22. A knitting apparatus according to claim 1 wherein said needles each include a transfer pocket on an upper portion of a shank of the needle, said needle having a lower shank portion below said transfer pocket, and including a microverge on said needle bed between each adjacent pair of needle grooves and having an upper end spaced a predetermined distance from the upper end of said needle bed to capture and hold previously formed stitch loops during subsequent stitch formation for uniform stitch formation even when spandex yarn is being knit, said microverges being of a height that said transfer pockets will pass thereover during movement of said needles.

23. A knitting apparatus according to claim 1, including a latch opening brush mounted for reciprocable movement perpendicular to said needles in said needle beds when said needles occupy their uppermost position and means for moving said brush perpendicular to all of said raised needles to open the latches thereof.

24. A method of knitting a fabric from a yarn on a flat bed knitting machine having a pair of opposing needle beds and banks of knitting needles slidably mounted in the needle beds, said method comprising selecting individual needles for actuation to form knit stitches in accordance with a predetermined pattern, moving each such individual needle independently of any other needles between its various positions required for stitch formation independently of the selection and actuation of the next needle in sequence, while varying the length of movement of individual needles to the stitch forming position to form stitches of uniform size and length in the knitted fabric, and feeding a yarn to the needles under such tension as to assist in the formation of stitches of uniform size and length.

25. A method according to claim 24 wherein the individual needles are moved to an upper knitting position, lowered to a yarn receipt or wrap position and then to a lower knitting or stitch forming position and the movement from the yarn receipt to the stitch forming position is varied in response to the length of a preceding stitch.

26. A method according to claim 25 wherein the needles are moved by a computer controlled rotary axis drive.

27. A method according to claim 24, including forming a tapered knit product by transferring stitches for selected needles in one needle bed to adjacent needles in the other needle bed.

28. A method according to claim 27 wherein the needles are selected and actuated to form a tubular tapered knit product by selecting and actuating all of the needles in one needle bed in sequence and thereafter selecting and actuating the needles in the other needle bed in the formation of each course.

29. A method according to claim 28, including forming the tubular tapered knit product from the wide end to the narrow end and with the wide end closed by commencing the knitting of the tubular tapered product by lacing the yarn about the needles in the opposing needle beds in alternation.

30. A method according to claim 29, including forming a cuff at the narrow end of the tubular tapered knit product by forming tighter, smaller stitches in a predetermined number of courses at such narrow end.

31. A method according to claim 30 wherein the tighter, smaller stitches are formed by shortening the length of movement of the needles to the stitching forming position and by increasing the tension in the yam forming those stitches.

32. A method according to claim 24, including taking down the knit fabric after the formation of each course and including holding each preceding course of stitches at a predetermined, common level relative to the needles during the formation of the immediately succeeding course to assist in the formation of stitches of uniform size and length throughout the knit fabric.

* * * * *